US007169099B1

(12) United States Patent
Kemery et al.

(10) Patent No.: US 7,169,099 B1
(45) Date of Patent: Jan. 30, 2007

(54) BALANCING OBJECT

(75) Inventors: Michael C. Kemery, Portland, OR (US); Tobin N. Guild, Portland, OR (US)

(73) Assignee: Nike International Ltd., Beaverton, OR (US)

( * ) Notice: Subject to any disclaimer, the term of this patent is extended or adjusted under 35 U.S.C. 154(b) by 240 days.

(21) Appl. No.: 10/667,952

(22) Filed: Sep. 22, 2003

(51) Int. Cl.
*A63B 22/16* (2006.01)

(52) U.S. Cl. ..... 482/146; 482/34

(58) Field of Classification Search ..... 482/146–147, 482/34, 79–80, 62; D21/662, 665, 671, 685, D21/760, 769; 280/841; 441/74
See application file for complete search history.

(56) References Cited

U.S. PATENT DOCUMENTS

| | | | | |
|---|---|---|---|---|
| 3,024,021 | A | 3/1962 | Coplin et al. | |
| 3,188,087 | A * | 6/1965 | Larson, Jr. | 273/115 |
| 3,488,049 | A | 1/1970 | Sasser, Jr. | |
| 3,895,794 | A * | 7/1975 | England | 482/146 |
| 3,984,100 | A | 10/1976 | Firster | |
| 4,191,371 | A | 3/1980 | Armer, Jr. | |
| D255,372 | S | 6/1980 | Tidmore | |
| 4,505,477 | A | 3/1985 | Wilkinson | |
| 4,601,469 | A | 7/1986 | Sasser, Jr. | |
| 4,759,542 | A | 7/1988 | Hudec | |
| 4,826,159 | A | 5/1989 | Hersey | |
| 5,152,691 | A | 10/1992 | Moscarello | |
| 5,190,506 | A | 3/1993 | Zubik et al. | |
| 5,213,554 | A * | 5/1993 | Goldstein et al. | 482/52 |
| 5,256,127 | A * | 10/1993 | Yeh | 482/146 |
| 5,292,296 | A | 3/1994 | Davignon | |
| 5,328,421 | A | 7/1994 | Stanalajczo | |
| 5,399,140 | A | 3/1995 | Klippel | |
| 5,545,115 | A | 8/1996 | Corcoran | |
| D376,629 | S | 12/1996 | Mounts et al. | |
| 5,584,787 | A | 12/1996 | Guidry | |
| 5,630,237 | A | 5/1997 | Ku | |
| 5,643,164 | A | 7/1997 | Teff | |
| 5,647,830 | A | 7/1997 | Togao | |

(Continued)

OTHER PUBLICATIONS

Balance Steps, MF Athletic Company, available online at: http://www.mfathletic.com/catalog/product.asp_Q_dept_id_E_253_A_pf_id_E_6738_6738_A_mscssid=UN545KSUM23X9P4FUMF8W4T6XEFTB151 on May 15, 2003.

*Primary Examiner*—Lori Amerson
(74) *Attorney, Agent, or Firm*—Shook, Hardy & Bacon, L.L.P.

(57) ABSTRACT

One or more balancing objects are provided having an arcuate roof onto which a user may step and a pair of sidewalls to support the roof. The arcuate roof is shaped such that a portion of a user's foot will contact the balancing object when standing on the roof, thereby challenging the user to maintain balance in a more unsteady state than when standing flat-footed. The sidewalls extend downwardly from lateral side regions of the arcuate roof and preferably have a concave profile extending laterally towards one another to provide superior strength to the balancing object when loaded under a user's weight. A frictional overmold may be formed over the arcuate roof to provide a frictional surface preventing a user's footwear from slipping off of the balancing object. Multiple balancing objects may be positioned on a flat, horizontal surface in a variety of orientations such that the user can target certain muscle groups to train for improving balance and proprioception.

9 Claims, 4 Drawing Sheets

U.S. PATENT DOCUMENTS

| | | | |
|---|---|---|---|
| 5,730,690 | A | 3/1998 | Guidry |
| 5,755,651 | A | 5/1998 | Homyonfer et al. |
| 5,810,703 | A | 9/1998 | Stack |
| D405,135 | S | 2/1999 | Scott |
| 5,897,474 | A | 4/1999 | Romero |
| 6,017,297 | A | 1/2000 | Collins |
| 6,019,712 | A | 2/2000 | Duncan |
| 6,146,343 | A | 11/2000 | Stewart |
| 6,413,197 | B2 | 7/2002 | McKechnie et al. |
| 6,461,285 | B1 | 10/2002 | Theunissen et al. |

* cited by examiner

BALANCING OBJECT

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The invention relates generally to balance improving devices, and more specifically, to balancing objects that may be oriented in various arrangements to provide balance training.

2. Discussion of the Related Art

The maintenance of physical fitness is of ever-increasing importance in our modern society. Scientific studies have shown that achieving good physical condition through exercise provides a person with increased energy and strength while reducing stress. One important component of physical condition is acquiring strong balance. Many muscle groups of the body are involved in maintaining a person's balance, especially when their body is in motion or in an otherwise relatively unbalanced state (e.g., standing on one foot). By practicing certain balance improving techniques, targeted muscle groups may be strengthened, improving a person's ability to control their body when engaging in a wide variety of activities, such as playing sports, exercising, lifting objects, etc. Therefore, improving balance—especially through activities that require motion—indirectly increases a person's flexibility and improves their proprioception A common scheme for practicing balance improvement is to step from one raised "balancing" object to another, or alternately between a raised object and a stable, broad flat surface. This method involves many major muscle groups, including those in a person's legs, abdomen and back, and as such, is highly beneficial in developing strong balance. Optimization of these types of balance improvement techniques may be achieved through designing raised objects that are structurally stable and can accommodate a user standing on the object, but with a shape that challenges the user to maintain their stance in equilibrium.

BRIEF SUMMARY OF THE INVENTION

One or more balancing objects having an arcuate roof are presented for improving a user's balance and proprioception. A user may step from the arcuate roof of one object to the arcuate roof of another object, or may stabilize their position by standing on one or two of the balancing objects, thereby training and developing targeted muscle groups. The balancing objects generally take the form of a shell with the arcuate roof on which the user stands spanning the length of the shell, and sidewalls formed along the sides of the arcuate roof to maintain the structural integrity of the object. The combination of the arcuate roof and sidewalls define an enclosed space for the object into which another balancing object may be inserted so that a number of balancing objects may be stacked together.

In one aspect, the sidewalls are configured to maintain the structural integrity of the balancing object. The sidewalls extends downwardly from side edges of the arcuate roof and have a concave profile extending laterally inward towards the enclosed area. The shape of the sidewalls reduce the tendency of the arcuate roof and the sidewalls to collapse or fold downward when a person applies their weight to the roof of the balancing object.

In another aspect, a frictional rubber or plastic overmold is disposed on a top surface of the arcuate roof. The frictional overmold has a surface that provide for betting gripping of a user's footwear when stepping onto the balancing object; the frictional surface may further have a series of raised ridges providing improved traction with the footwear. The overmold may also be extended to wrap around opposed footings of the arcuate roof such that bottom edges of the sidewalls are raised above a horizontal surface onto which the object is placed. In this way, the friction provided by the overmold contacting the horizontal surface will inhibit the balancing object from sliding across the horizontal surface when a user steps onto the object.

In another aspect, one or more bracing ribs are formed onto a bottom surface of the arcuate roof to provide structural reinforcement to prevent downward collapsing of the roof when loaded. Each bracing rib extends longitudinally along the arcuate roof bottom surface and may extend substantially from one base end of the roof to the opposed base end.

In another aspect, each sidewall of the balancing object has a emboss formed on an inner surface thereof, and a corresponding deboss formed on an outer surface thereof and configured to matingly receive the emboss of another balancing object to secure the two balancing objects together when one object is placed within the enclosed space of the other object.

Thus, the balancing object of the present invention provides a stable structure while challenging the user with an arcuate roof for developing varying degrees of balance. A user standing with their foot generally centered on and aligned longitudinally with the arcuate roof can engage in flexion and extension with their foot to improve more degrees of their balance. Two or more balancing objects may also be positioned relative to each other at any orientation (e.g., forward and back, laterally, diagonally) on a generally horizontal surface and the user may repeatedly step from one object to the other to develop dynamic balance and proprioception.

DETAILED DESCRIPTION OF THE INVENTION

Figure 1:
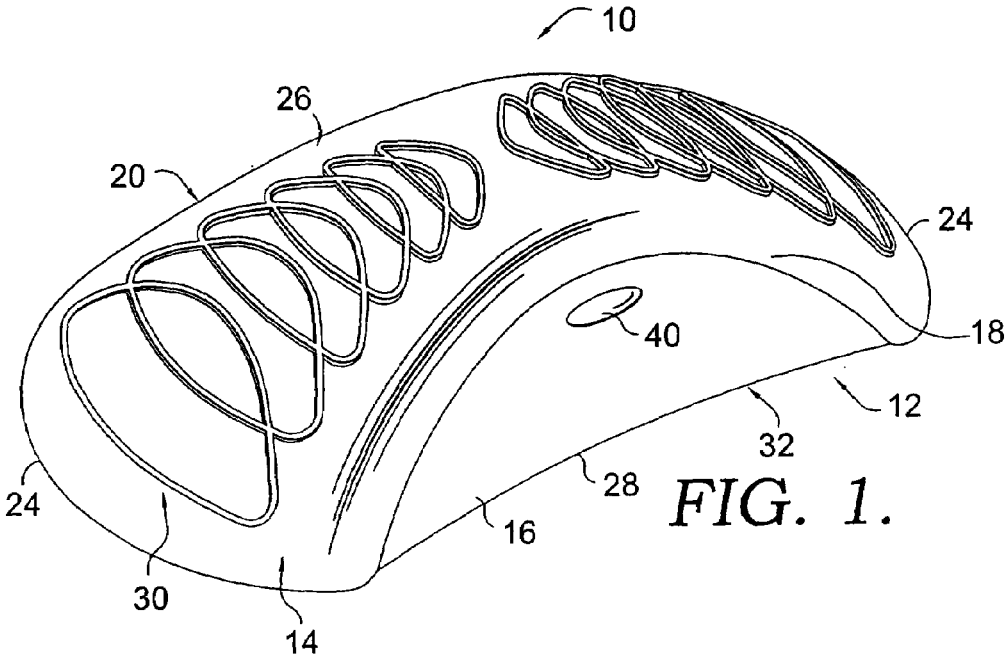
FIG. 1 is a top perspective view of the balancing object in accordance with one embodiment of the invention.

One balancing object of one embodiment of the present invention is shown generally at 10 in FIGS. 1–5. The balancing object 10 is ideally positioned on a flat, generally horizontal surface 100 for use, as will be more fully described herein. Shaping the balancing object 10 into the configuration of a shell 12 is a longitudinally-extending arcuate roof 14 peaking at an apex 15 and a pair of sidewalls 16 extending downwardly from opposed lateral side regions 18 of the roof 14. The balancing object 10 is designed to be laterally symmetrical about longitudinal centerline $C_L$. Also, the shell 12 may be molded into a single unitary body and formed of a variety of composites, such as plastics.

Figure 2:
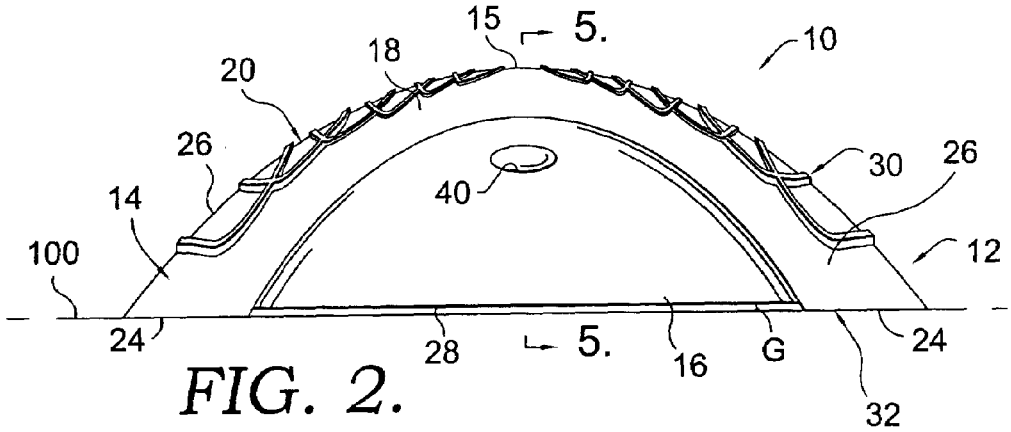
FIG. 2 is a side elevational view of the balancing object.
Figure 3:
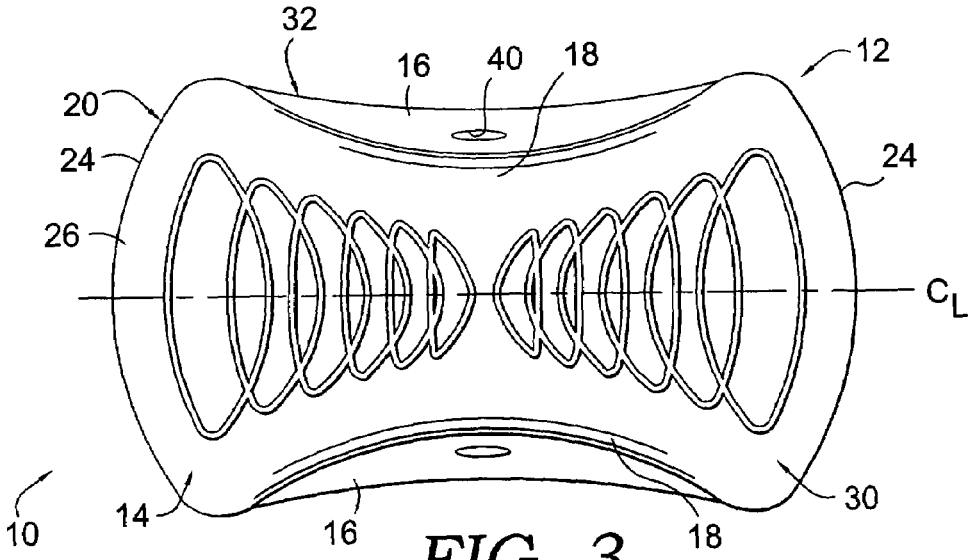
FIG. 3 is a top plan view of the balancing object.
Figure 5:
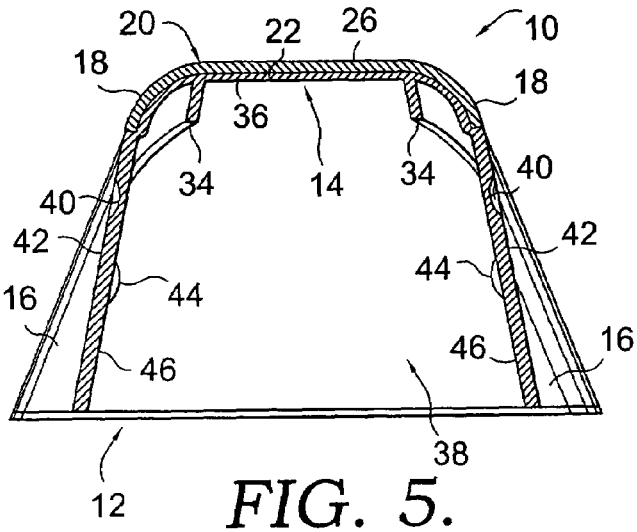
FIG. 5 is a cross-sectional view of the balancing object taken along line 5—5 showing the reinforcing ribs and the emboss and deboss.

In one preferred arrangement, a frictional overmold 20 made of a rubber or plastic material, or combination thereof, is affixed to the shell 12 and enshrouds the arcuate roof 14 with a shape that is generally the same as the shape of the underlying roof 14. The overmold 20 covers essentially the entire upper surface 22 of the arcuate roof 14, as shown in FIG. 5, as well as opposed footings 24 of the roof 14, thereby serving two functions. First, the overmold 20 covering the roof upper surface 22 provides a frictional surface 26 to engage with footwear worn by a user to aid in the prevention of slippage off of the balancing object 10. Secondly, by having the overmold 20 wrap around the footings 24 of the arcuate roof 14, the overmold 20 is the only part of the balancing object 10 that actually touches the horizontal surface 100 when unloaded. In fact, base edges 28 of the sidewalls 16 do not touch the horizontal surface 100 until a sufficient load is reach that will cause the arcuate roof 14 and/or the sidewall 16 itself to deflect downward a distance such that the sidewall base edges 28 move the distance of gap G, as shown in FIG. 2. By having only the overmold 20 contact the horizontal surface 100 under most loading conditions, the balancing object 10 will resist sliding thereacross when a user steps onto the object 10. The overmold 20 may further have a series of raised ridges 30 that provide improved traction with a user's footwear.

The opposed footings 24 of the arcuate roof 14 enshrouded by the frictional overmold 20 generally have a convex profile extending away from one another or longitudinally outward along Centerline $C_L$. Conversely, the sidewalls 16 generally have a concave profile extending laterally towards one another. This configuration for the opposed footings 24 and the sidewalls 16 provides the balancing object with superior strength as compared to a traditional spherical dome design in that the sidewalls 16 and arcuate roof 14 are more resistant to folding or collapsing downward when loaded by a user standing longitudinally on the roof 14.

In an alternative arrangement, the opposed footings 24 may have a concave profile and the sidewalls 16 may have a convex profile while still achieving the strength advantages over a traditional spherical dome design. Furthermore, one of the opposed footings 24 or the sidewalls 16 may alternatively have a straight-line profile. However, at least one of the arcuate roof footings 24 and the sidewall base edges 28 should not have a convex profile, so that a base perimeter edge 32 of the balancing object 10 is formed into a shape that is non-circular and preferably non-elliptical.

Figure 4:
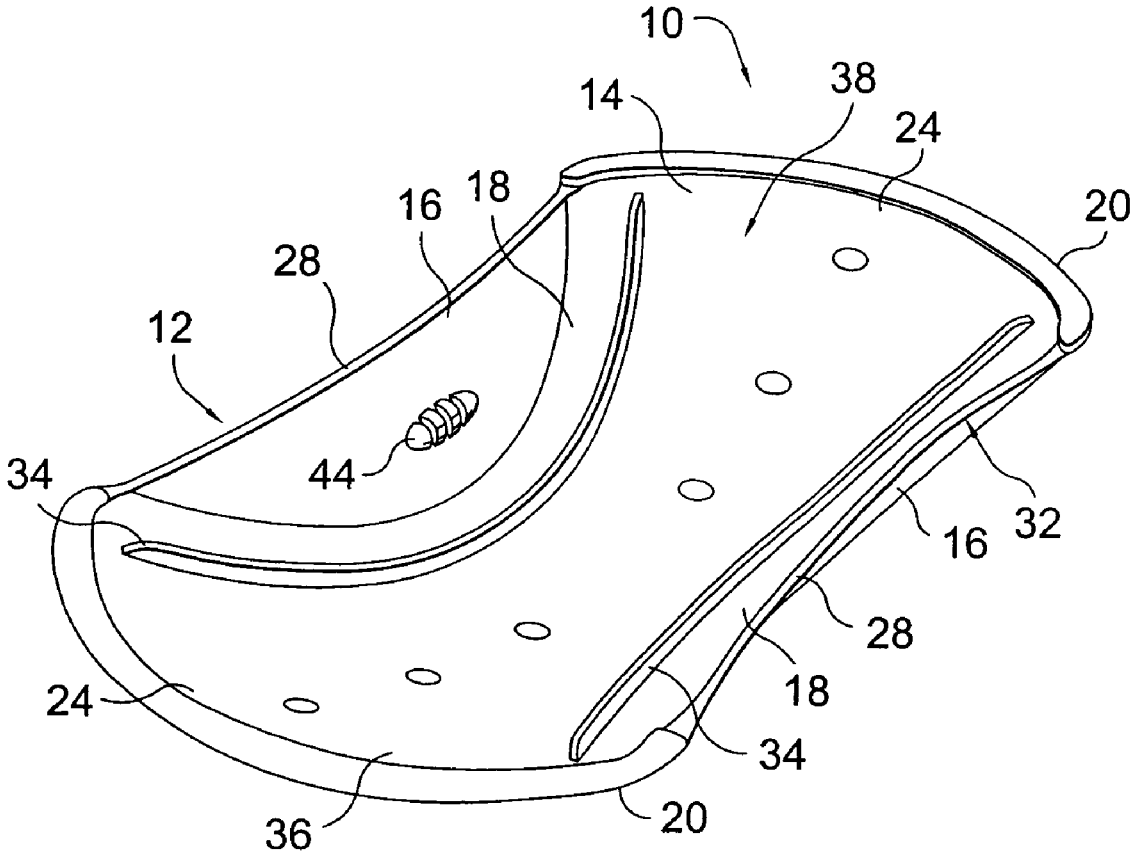
FIG. 4 is a bottom perspective view of the balancing object.

A pair of bracing ribs 34 are shown in FIGS. 4 and 5 extending generally longitudinally along a lower surface 36 of the arcuate roof 14 within an enclosed space 38 thereof. The bracing ribs 34 are formed near the lateral side regions 18 of the arcuate roof 14 and adjacent to the sidewalls 16 such that the ribs 34 have an arcuate shape in the same fashion as the roof 14 while also having a concave profile similar to the sidewalls 16. Also, the bracing ribs 34 preferably extend from proximal one roof footing 24 to proximal the opposed roof footing 24. In this way, the bracing ribs 34 provide strength and rigidity to the shell 12 to prevent the arcuate roof 14 from collapsing downwardly or the sidewalls 16 and roof 14 from buckling laterally and downwardly at the lateral side regions 18. If desired for further strengthening, additional bracing ribs may be disposed on the arcuate roof lower surface 36 between the ribs 34.

Figure 6:
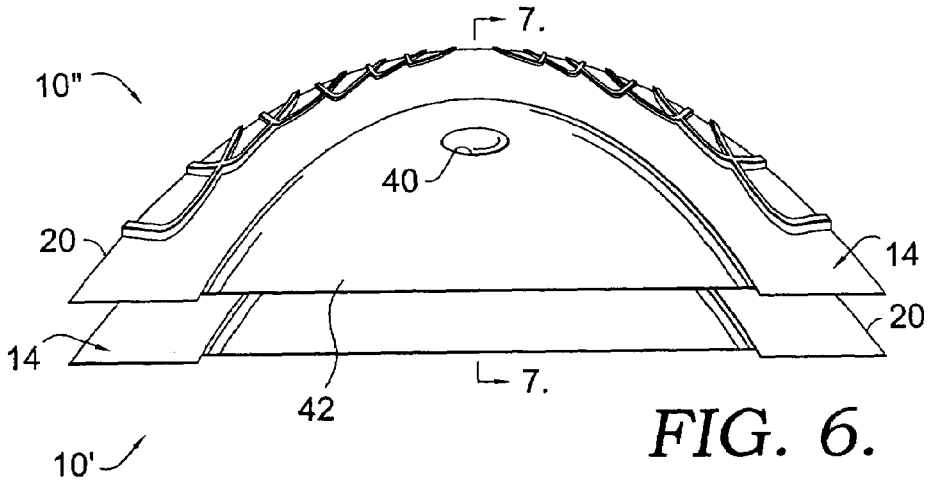
FIG. 6 is a side elevational view showing two balancing objects stacked together for storage or carrying.
Figure 7:
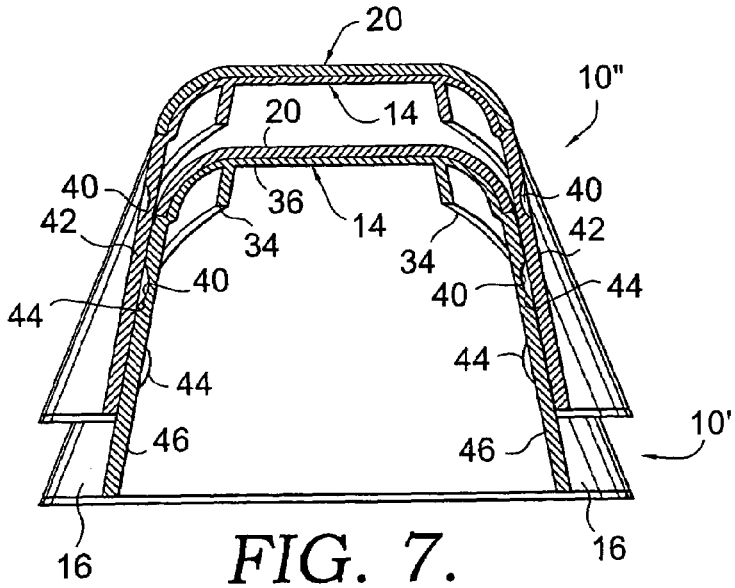
FIG. 7 is a cross-sectional view of the balancing object taken along line 7—7 showing the emboss of one balancing object mating with the deboss of another balancing object to secure the balancing objects together.

FIGS. 5–7 show features for removably attaching multiple balancing objects 10 together. Debosses 40 are formed into outer surfaces 42 of the sidewalls 16 and corresponding embosses 44 are formed on inner surfaces 46 of the sidewalls 16, the embosses 44 being shaped to fit within the debosses 40. This configuration allows a first balancing object 10' to be received within the enclosed space 38 of a second balancing object 10" and secured thereto by the embosses 44 of the second balancing object 10" sliding along the sidewall outer surfaces 42 of the first balancing object 10' and snapping into engagement with the debosses 40 thereof. At this point, both balancing objects 10', 10" may be carried together simply by holding onto the upper or second balancing object 10". Subsequently, the balancing objects 10', 10" may be separated from one another by either pulling the balancing objects 10', 10" in opposite directions to move the embosses 44 out of the debosses 40, or by squeezing or otherwise moving the sidewalls 16 of the first balancing object 10 towards one another so that the lateral width of the first balancing object 10' at the debosses 40 is less than the lateral width of the second balancing object 10" at the embosses 44 and the objects 10', 10" may be pulled away from one another. In either the joining together or separation of the balancing objects 10', 10", the lateral flexibility of the sidewalls 16 facilitates the ease of movement of the embosses 44 into or out of engagement with the debosses 40. If desired, additional balancing objects 10 may be joined together in the same fashion as the first and second balancing objects 10', 10" by stacking within the enclosed space 38 of the first balancing object 10' and/or over the arcuate roof 14 of the second balancing object 10". It should also be understood that the positions of the embosses 44 and debosses 40 may be reversed as a matter of design choice.

Figure 8:
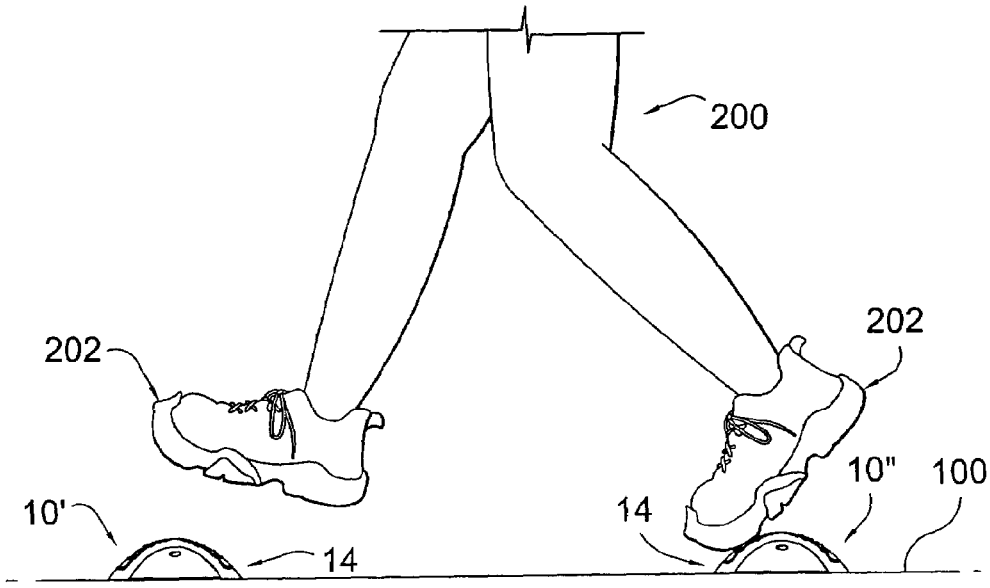
FIG. 8 is an illustrative side view of two balancing objects and a user stepping between the balancing objects.

An illustration of the first and second balancing objects 10', 10" in use is depicted in FIG. 8. A user 200 has a number of options regarding their stance on the arcuate roof 14 of the balancing objects 10', 10" as well as their movements relative to the objects 10', 10". For example, the user 200 may stand relatively motionless with a foot 202 on each of the balancing objects 10', 10"—or with merely one foot on one of objects 10', 10" and the other foot suspended above the horizontal surface 100—to develop their static balance. The user 200 may alternatively step or shift their weight back and forth between the first and second balancing objects 10', 10" to develop their dynamic balance and proprioception. Because the arcuate roof 14, or more particularly, the frictional overmold 20 onto which the user 200 positions their foot 202, is a non-flat surface, typically the user 200 can place merely a portion of their foot 202 on the roof 14 while the rest of their foot 202 is suspended in mid air (as seen in FIG. 8), thereby challenging the user to maintain balance in a more unsteady state than when standing flat-footed.

Figure 9:
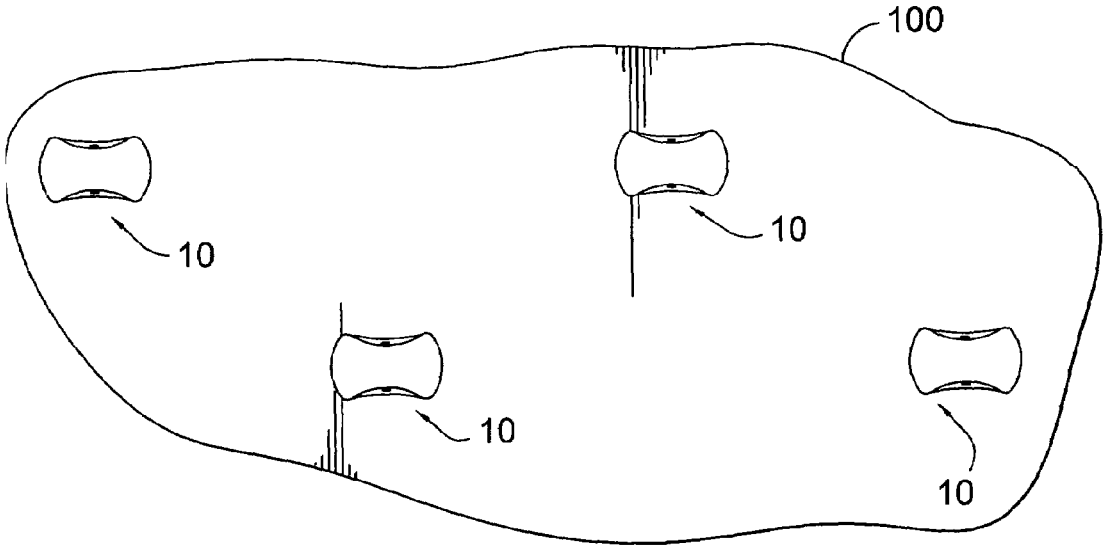
FIG. 9 is an illustrative top view of an exemplary layout for a series of balancing objects.

FIG. 9 shows an exemplary layout for multiple balancing objects 10 such that a user may repeatedly step forward and backward on the objects 10 to further customize their workout. By positioning the balancing objects 10 relative to each other in any orientation on the horizontal surface (e.g., forward and back, laterally, diagonally), the user is able to target the desired muscles to be trained and can closely tailor the difficulty of the workout to their needs.

As such, the balancing objects 10 of the present invention provide an individual with a superior tool for the development of static and dynamic balance, and proprioception. The balancing objects 10 have a shape that allows for various foot positioning on the arcuate roof 14 to more fully train the muscle groups of a user necessary for achieving strong balance. The shape and configuration of the balancing objects 10 also provide a design that is strong, yet lightweight, and easily portable with multiple objects 10 stackable together.

Since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. A device for improving the balance and proprioception of a user, comprising:

an arcuate roof extending upwardly from opposed footings to an apex thereof, the arcuate roof having an upper surface, a lower surface and opposed lateral side regions, and a longitudinal centerline extending between the opposed footings;

a pair of sidewalls each having an outer surface and an inner surface and extending downwardly from the lateral side regions of the arcuate roof, the sidewalls combining with the arcuate roof to define an enclosed space, and the sidewalls having a concave profile extending laterally towards one another;

an emboss formed on each sidewall inner surface; and a deboss formed on each sidewall outer surface and configured to matingly receive the emboss of another balancing device therein to secure the two balancing devices together when one balancing device is placed substantially within the enclosed space of the other balancing device.

2. A balancing device, comprising:

an arcuate roof extending upwardly from opposed footings to an apex thereof, the arcuate roof having an upper surface, a lower surface and opposed lateral side regions, and a longitudinal centerline extending between the opposed footings at least one arcuate bracing rib formed on the lower surface of the arcuate roof and extending from a point proximal to one of the opposed footings of the arcuate roof to a point proximal to the other of the opposed footings of the arcuate roof; and a pair of non-parallel sidewalls extending downwardly from the opposed lateral side regions of the arcuate roof to form base edges of the sidewalls, the sidewalls combining with the arcuate roof to define an enclosed space;

wherein a base perimeter edge of the device formed by the opposed footings of the arcuate roof and the base edges of the sidewalls presents a shape that is non-circular.

3. The device of claim 2, wherein the footings of the arcuate roof have a convex profile extending outwardly along the longitudinal centerline away from one another.

4. The device of claim 2, wherein the sidewalls have a concave profile extending laterally towards one another.

5. The device of claim 2, further comprising an overmold configured to enshroud the upper surface of the arcuate roof and having a frictional upper surface to engage with footwear of a user.

6. The device of claim 5, wherein the upper surface of the overmold has a series of raised ridges providing improved traction with footwear of a user.

7. The device of claim 5, wherein the overmold further enshrouds the footings of the arcuate roof such that when the unloaded device is placed on a flat surface, the base edges of the sidewalls are raised above the surface as the overmold contacts the surface.

8. The device of claim 2, wherein the sidewalls each have an outer surface and an inner surface, and further comprising:

a emboss formed on the sidewall inner surface; and a deboss formed on the sidewall outer surface and configured to matingly receive the emboss of another device therein to secure the two devices together when one device is placed substantially within the enclosed space of the other device.

9. A balancing device, comprising:

an arcuate roof extending upwardly from opposed footings to an apex thereof, the arcuate roof having opposed lateral side regions; and a pair of non-parallel sidewalls extending downwardly from the lateral side regions of the arcuate roof and having an inner surface and an outer surface, the sidewalls combining with the arcuate roof to define an enclosed space, the inner surface having an emboss formed thereon and the outer surface having a deboss formed therein and configured to matingly receive the emboss of another balancing device therein to secure the two balancing devices together when one balancing device is placed substantially within the enclosed space of the other balancing device.

* * * * *